United States Patent [19]

Gall et al.

[11] 4,081,317

[45] Mar. 28, 1978

[54] PROCESS FOR THE REDUCTION OF EFFLUENT COLOR FROM A CELLULOSIC PULP BLEACHING SEQUENCE

[75] Inventors: Ralph J. Gall, Amherst; Frederick H. Thompson, Grand Island, both of N.Y.

[73] Assignee: Hooker Chemicals & Plastics Corporation, Niagara Falls, N.Y.

[21] Appl. No.: 612,613

[22] Filed: Sep. 11, 1975

Related U.S. Application Data

[63] Continuation of Ser. No. 425,751, Dec. 18, 1973, abandoned, which is a continuation-in-part of Ser. No. 311,046, Nov. 30, 1972, abandoned, which is a continuation-in-part of Ser. No. 108,995, Jan. 22, 1971, abandoned.

[51] Int. Cl.[2] ..... D21C 9/14

[52] U.S. Cl. ..... 162/80; 8/108 A; 162/88; 162/89; 162/90

[58] Field of Search ..... 162/80, 88, 89, 90; 8/108 R, 108 A

[56] References Cited

U.S. PATENT DOCUMENTS

| | | | |
|---|---|---|---|
| 3,345,250 | 10/1967 | Brinkley et al. | 162/88 X |
| 3,423,282 | 1/1969 | Rerolle et al. | 162/88 X |
| 3,433,702 | 3/1969 | Jack et al. | 162/88 X |

*Primary Examiner*—Arthur L. Corbin

*Attorney, Agent, or Firm*—Peter F. Casella; Howard M. Ellis; Thomas T. Gordon

[57] ABSTRACT

The colored body content of the effluent from the alkali of a multi-stage cellulosic pulp bleach process is greatly reduced by extracting bleached cellulosic pulp with hypochlorite at a pH from about 6 to less than 9.

15 Claims, No Drawings

PROCESS FOR THE REDUCTION OF EFFLUENT COLOR FROM A CELLULOSIC PULP BLEACHING SEQUENCE

This is a continuation of application Ser. No. 425,751, filed Dec. 18, 1973, now abandoned which is a continuation-in-part of Ser. No. 311,046, filed Nov. 30, 1972, now abandoned which in turn is a continuation-in-part of Ser. No. 108,995, filed Jan. 22, 1971, now abandoned.

BACKGROUND OF THE INVENTION

Industrial waste water effluents present problems of purification which are quite different from the problems of municipal sewage treatment. The waste streams from each industrial process type is unique to that process and requires specialized rectification. Generally, neutralization of acidic or alkaline waste materials to obtain a pH between approximately 6–9, while of extreme importance in water pollution control, may be readily achieved by direct chemical treatment. The removal, solubilization or passivation of specific contaminants presents problems more difficult of solution, which ofttimes require a combination of physical, bio-chemical and chemical treatments. Especially trying is the problem of preventing color contamination of surface water into which industrial waste streams are discharged. Color contamination of surface water presents a visible asthetic problem as well as the problem of altered light penetration of the surface water.

In the pulping industry, the brown color of pulping effluents is largely the result of extracted tannins, lignins and their derivatives removed from the cellulosic pulp by washing of the pulp after selected chemical treatment stages. The bulk of the colored material is removed from the cellulosic bleaching process in the caustic extraction stage, which removes from the cellulosic material the previously solubilized non-cellulosic content of the pulp. Lignin and its chlorinated and oxidized derivatives are highly resistant to microbiological degradation and a color inherent in such lignin extracts pass through most biological treatment stations into the surface water discharge. Although chemical treatment of the colored bodies in pulp mill effluents is a very effective technique for reducing the content of colored bodies, the economics of such systems are exorbitant and therefore impractical in modern day technology. Therefore, chemical removal of colored material is not generally applied to pulp mill effluents in practice. The use of activated sludge facilities may be employed to remove from between about 10–15 percent of the color in the waste water effluent from a kraft pulp mill and its bleach plant. Thus, between 85 and 90 percent of the colored material from a kraft pulp mill and its bleach plant will pass through the bio-chemical degradation step into surface water disposal.

The purification of pulp mill effluents pose a unique problem in waste water treatment because the effluents are less amenable to conventional water treatment procedures known and applied today in municipal waste water purification. Because pulp mill effluents contain trace metals and chemical compounds that resist biological degradation, the first line of attack in water pollution abatement resides in the chemical treatment applied to the pulp to achieve the desired product. Any change in the actual processing of pulp treatment which provides an effluent containing fewer contaminants carries with it the reduced requirements for effluent treatment before discharge of wastes to surface water. This first line of attack, the actual chemical bleach technique employed, poses the combined problems of economics, effectiveness of the chemical treatment, as well as the achievement of the desired bleached product characteristics demanded by the pulp and paper industry, and is critical in any active program of water pollution abatement. Thus, although changes in the chemical processing of pulp may not be considered a panacea for water pollution abatement, dramatic improvements in pulp mill bleaching are essential to achieve those desired goals.

One conventional bleach sequence employed as a multi-stage bleaching process for soft wood pulp involves the initial treatment of the cellulosic pulp with chlorine followed by a second stage caustic extraction, a third stage hypochlorite bleach and a fourth stage chlorine dioxide bleach stage. This multi-stage bleach process is conventionally designated CEHD, the letters respectively representing chlorination, extraction, hypochlorite treatment, and a chlorine dioxide treatment. The extraction stage of this bleach sequence is responsible for about 88 percent of the total color coming from the entire multi-stage bleach process. In a laboratory scale application of the bleach sequence CEHD to soft wood pulp it was discovered that the amount of colored bodies appearing in the bleach liquors after each stage of treatment, corrected as to volume, was approximately 332 ppm after chlorination, 2953 ppm after extraction, 23 ppm after hypochlorite treatment and 39 ppm after chlorine dioxide application, for total color body content of the effluent from the bleach sequence of 3,347 parts per million.

Although the effluent from a soft wood bleaching process is much more highly colored than the effluent from hardwood bleaching by the same process, either effluent is objectionable. It was discovered, through application of the bleach sequence CEHD to a hardwood pulp that colored body effluent contamination after each stage of treatment, corrected as to volume, was approximately 227 after chlorination, 809 after extraction, 27 after hypochlorite treatment and 78 after chlorine dioxide application, for a total color body content of the effluent from the bleach sequence of 1,141 parts per million.

Regional and state efforts to control the color of discharge pulp mill effluents have placed a standard of water quality upon discharged effluents at about 50 parts per million APHA (American Public Health Association) as a near term goal. Hence, any contribution which will assist in reaching this goal represents a decided advance in the art of pollution control.

SUMMARY OF THE INVENTION

Applicants have discovered that in multi-stage processes for bleaching cellulosic pulp utilizing a first stage treatment or solubilizing non-cellulosic material associated with said pulp, the conventional second stage alkaline extraction step may be omitted or combined with a subsequent hypochlorite bleach stage to produce an effluent containing a colored body content from between 50–90 percent below that resulting from the conventional alkaline extraction of solubilized non-cellulosic materials.

In accordance with applicants invention, there is provided a process for bleaching a cellulosic pulp which comprises treating said pulp in aqueous suspension with at least one member selected from the group consisting of chlorine and chlorine dioxide to solubilize non-cellulosic material associated with said cellulosic pulp, and thereafter treating said pulp at a weight consistency of from 3 to 15 percent to hypochlorination with from about 0.5 to about 3.0 percent hypochlorite on a dry pulp weight basis at a temperature from about 75 to about 160 degrees F., at a pH from about 6 to less than 9 for from 15 to 180 minutes.

Applicants have surprisingly discovered that not only is the color of the effluent from a second stage hypochlorite bleach step in a multi-stage bleaching process for cellulosic pulp pH dependent, but the amount of colored material produced is also pH dependent. Thus, applicants have discovered that the color of the effluent from a conventional bleach sequence CEHD may be reduced by a factor of from 50–90 percent by omitting the caustic extraction stage and controlling the pH of the hypochlorite stage between about 6 to less than 9. The pH control of the hypochlorite bleach stage may be effected by the addition of alkaline materials or through the use of a buffer to achieve a pH of from between about 6 to less than 9 and preferably 6 to 8.5 and more preferably from 6 to 8.2. The use of a buffer system to control the pH during the hypochlorite bleach stage may be preferred under some circumstances to the direct addition of an alkaline material to adjust the pH, particularly where less than adequate mixing occurs.

A more recent innovation in the field of multi-stage cellulosic pulp bleaching resulted from the discovery by Jack et al. (U.S. Pat. No. 3,433,702) of a first stage bleach sequence employing chlorine dioxide followed by chlorine coupled with a second stage caustic extraction, a third stage hypochlorite bleach and a fourth stage chlorine dioxide treatment. This bleach sequence may be designated $D_cEHD$. In accordance with this invention, by omitting the second stage alkaline extraction in the process $D_cEHD$ and substituting a hypochlorite bleach stage under conditions of controlled pH, the quantity of colored material in the effluent is reduced in the same manner as it is reduced from the sequence CEHD.

Any alkaline material may be employed to control the pH of the hypochlorite bleach stage of this invention which does not otherwise interfere with the hypochlorite bleaching process. For example, the alkaline earth metal hydroxides and alkali metal hydroxides may be employed to control the pH of the hypochlorite bleach stage. Preferably sodium hydroxide is the reagent used because of its availability and cost.

Likewise, any buffer system which is inert toward the reactants involved in the hypochlorite bleach stage and which will produce a pH of between approximately 6 to less than 9 may be effectively employed. For example, buffer systems consisting of potassium acid phosphate-disodium phosphate; potassium acid phosphate-sodium hydroxide; boric acid-borax; borax; boric acid-sodium hydroxide as well as water soluble alkali and alkaline earth metal silicates may be employed to control the pH of the hypochlorite bleach stage. Of these buffers it is preferred to employ a water soluble alkali metal silicate of the formula $Na_2O(SiO_2)_x$ in which $x$ equals 2–4. The amount of the water soluble silicate added to the hypochlorite bleach stage may vary from about 0.5 to about 5%, with smaller amounts of the water soluble silicate resulting in lower final pH values in the hypochlorite bleach stage as well as lower quantities of color measured in parts per million in the effluent from the hypochlorite bleach stage. Thus, it is preferred to employ $Na_2SiO_3$ as the buffering agent in quantities of from about 0.5 to about 1% by weight based upon the dry weight of pulp being treated. A buffer need not be employed alone during the hypochlorite bleach stage, but a small amount of sodium hydroxide may be introduced with the hypochlorite during the bleaching action. However, the amount of sodium hydroxide added to the hypochlorite bleach stage in conjunction with a sodium silicate buffer raises the final pH of the pulp and consequently increases the quantity of colored material in the effluent from the hypochlorination stage. With an increasing amount of sodium hydroxide present in conjunction with the silicate buffer during hypochlorination, the brightness of the ultimate product is increased slightly and the reversion after 18 hours decreases as the concentration of sodium hydroxide increases. The viscosity of the pulp after hypochlorination in the presence of sodium hydroxide and a silicate buffer is not effected in sodium hydroxide concentrations varying from between 0.5 to 2.0% based upon the dry weight of the pulp being treated.

The greatest reduction in color content of the effluent from a second stage alkaline extraction of a multi-stage bleach sequence resulted from a first stage sequential chlorine dioxide - chlorine treatment followed by the hypochlorite bleach treatment of this invention under controlled conditions of pH. To minimize the production of colored material in the effluent from pulp mill bleaching following a first stage sequential bleach and a second stage hypochlorite bleach, the optimum ratio of chlorine dioxide to chlorine on an equivalent chlorine basis in the first stage reaction is from 1:2 to 2:1, and more preferably a 1:1 ratio of chlorine dioxide to chlorine, should be used.

The temperatures employed during the multi-stage bleach sequence of this invention are those conventionally employed in the art. Thus, a temperature range for the first stage bleach treatment may vary from 75° to about 100° F, while no dramatic change in effect is noted at temperatures as high as 120° to 140° F., during treatment of the cellulosic pulp with chlorine dioxide and chlorine. Likewise, the second stage hypochlorite bleach may be conducted at temperatures from about 75° to about 120° F., without dramatic changes occurring at temperatures as high as 160° F.

The application times for each stage of the multi-stage bleach process of this invention are those conventionally employed in the art. It has been found that an optimum time for hypochlorite treatment under the conditions of controlled pH expressed in this application is about 60 minutes. However, treatments with hypochlorite may be applied over a period of 15 minutes to 180 minutes with results varying somewhat based upon the type of pulp being treated and upon the conditions employed for the first stage treatment. Generally, a treatment period of from 30 to 90 minutes is satisfactory.

The use of a buffered hypochlorite bleach treatment as the second stage of a multi-stage bleaching process is applicable to both hard and soft wood pulp. The greatest reduction in color accompanies the use of a second stage buffered hypochlorite bleach treatment on soft wood pulp prepared by the sulfate (kraft) or sulfite processes. This reduction in color is especially noteworthy because the soft wood pulps produce the greatest amount of colored effluent. The reduction in color from a conventional second stage caustic extraction performed on kraft pulp by substitution of the buffered hypochlorite bleach stage herein disclosed is from 70 to 90 percent whereas the reduction in effluent color in hard wood bleaching is from 50 to 70 percent under analogous conditions.

An additional advantage attending the application of a second stage buffered hypochlorite bleach treatment rather than the conventional caustic extraction resides in an increased yield of pulp. Thus, in comparing the multi-stage bleach sequences CEHD and $D_cH_sD$, it was found that the yield of pulp increased in the latter sequence by 0.5 percent when applied to soft wood pulp and 1.0 percent when applied to hard wood pulp. These increases in pulp yield represent the average of five independent experiments performed on different soft and hard wood pulp samples. Thus, the pulp yield increases resulting from the bleach sequence $D_cH_sD$ are quite significant and represent a decided advantage over the more conventional sequence CEHD.

DETAILED DESCRIPTION OF THE INVENTION

To illustrate applicants invention, the following examples are presented to compare the color content of effluent from a conventional CEHD multi-stage bleach sequence run under exact conditions of an operating pulp mill with the effluents from the process of this invention. All of the laboratory bleaching procedures were carried out in accordance with accepted practice. The physical and chemical properties of the unbleached and bleached pulps were determined in accordance with the following standard procedures:

TAPPI Standards and Other Testing Methods

Forming hand sheets for optical tests with pulp — T218-m59
Conditioning of paper and paper board for testing — T402-m49
Brightness of pulp - Elrepho Instrument Used — T217-m48
Cupriethylenediamine dispersed viscosity of pulp — T230-mu63
Hyponumber — McLean, J. D. Pulp and Paper Magazine of Canada, 66, No. T103-T106 (1965)
Effluent Color — Hach Colorimeter.

The color of the respective effluents obtained from the multi-stage bleach processes hereinafter exemplified were measured in accordance with the following procedure:

1. Upon completion of the specific stage, separate the pulp from the aqueous solution using a Buchner funnel.
2. Measure the volume of the undiluted effluent.
3. Adjust the pH to 7.0.
4. Place the sample in the Hach colorimeter and determine if it may be read directly or requires dilution.
5. Read the color using the Hach colorimeter. The color is recorded directly in parts per million.
6. Correct for dilution, if necessary.
7. Report the color in parts per million for the specific stage.

In the following tabulations of results for each Example, the color of the effluent from each specific stage is reported in parts per million as the direct color reading, as corrected for the consistency of the pulp being treated, and as corrected for volume differences between the stages. The total additive color figure corrected for volume is also presented. The reported total chlorides, COD (chemical oxygen demand) and solids were determined on the effluent from each stage and the total calculated in a manner similar to that for total color. Standard analytical procedures were employed in the determination of chlorides, COD and solids.

EXAMPLE 1

A sample of loblolly pine pulp having a hypo number of 5.6 and viscosity of 30.7 centipoises was subjected to the commercial CEHD bleach sequence in accordance with the conditions tabulated below:

| Stage | Chemical Addition % based on Pulp weight | Time Min. | Temp. ° F | Pulp Cons. % |
|---|---|---|---|---|
| (C)hlorination | 6.5 | 60 | 100 | 3 |
| (E)xtraction | 2.0 | 60 | 160 | 10 |
| (H)ypochlorination | 1.15 | 60 | 115 | 10 |
| (D) Chlorine Dioxide | 0.45 | 180 | 160 | 3* |

*3% consistency has been chosen for ease of laboratory operation. Results obtained are equivalent to those when using a consistencyof 10-12%.

The volume and color of the effluent undiluted by wash water from each stage was measured and the brightness, reversion (1 and 18 hours at 105° C.) and viscosity were determined. This sequence, run on the sample of pine pulp, served as a control.

The results obtained from this control study are as follows:

In addition, the effluent from the CEHD sequence contained 719 parts per million chlorides, 1854 parts per million solids and had a COD of 813 parts per million.

TABLE 1

BLEACH RESPONSE AND EFFLUENT COLOR OF SOFTWOOD PULP TO THE CONTROL CEHD SEQUENCE

| Stage | Temp. ° F. | Time, Min. | Const. % |
|---|---|---|---|
| C | 100 | 60 | 3 |
| E | 160 | 60 | 10 |
| H | 115 | 60 | 10 |
| D | 160 | 180 | 3 |

| Bleach Stage | C | E | H/NaOH | D |
|---|---|---|---|---|
| Chem. Addition wt. % | 6.5 | 2.0 | 1.15/0.5 | 0.45 |
| Color, ppm | | | | |
| Colorimeter Reading | 850 | 27,000 | 210 | 100 |
| Consistency Corrected | 850 | 7,560 | 59 | 100 |
| Volume Corrected | 332 | 2,953 | 23 | 39 |
| Brightness, % | | | | |
| Final | 90.5 | | | |
| Reversion | | | | |
| Δ - 1 hour | 4.2 | | | |
| Δ - 18 hours | 8.5 | | | |
| Viscosity, Centipoise | 9.9 | | | |

EXAMPLE 2

This is a comparative example employing a sample of the pulp used in Example 1 illustrating the instant invention performed in the bleach sequence $CH_sD$. It should be noted that reference to the multi-stage bleach sequence $CH_sD$ refer to the bleach stages of chlorination, hypochlorite buffered with silicate and finally bleaching with chlorine dioxide.

TABLE 2

BLEACH RESPONSE AND EFFLUENT COLOR OF SOFTWOOD PULP TO A $CH_sD$ SEQUENCE WITH SODIUM SILICATE BUFFER IN THE HYPOCHLORINATION STAGE

| Stage | Temp. ° F. | Time, Min. | Consistency % |
|---|---|---|---|
| C | 100 | 60 | 3 |
| $H_s$ | 110 | 60 | 10 |
| D | 160 | 180 | 3 |

| Stage | Chem. Addn. % | pH 7 | Color, ppm Consistency Corrected | Color, ppm Volume Corrected | Brightness, % Final | Brightness, % Reversion Δ - 1 hr. | Brightness, % Reversion Δ - 18 hrs. | Viscosity centipoise |
|---|---|---|---|---|---|---|---|---|
| C | 6.5 | 1,025 | 1,025 | 450 | | | | |
| H | 2.0 | 3,290 | 921 | 404 | | | | |
| | 0.5 | | | | | | | |
| NaOH | 1.1 | | | | | | | |
| D | 0.5 | 80 | 80 | 35 | 84.6 | 7.3 | 14.2 | 15.2 |
| C | 6.5 | 1,025 | 1,025 | 450 | | | | |
| H | 2.5 | 2,740 | 767 | 336 | | | | |
| | 0.5 | | | | | | | |
| NaOH | 1.1 | | | | | | | |
| D | 0.5 | 70 | 70 | 31 | 86.6 | 6.6 | 14.3 | 15.9 |
| C | 6.5 | 1,025 | 1,025 | 450 | | | | |
| H | 3.0 | 340 | 235 | 103 | | | | |
| | 0.5 | | | | | | | |
| NaOH | 0.9 | | | | | | | |
| D | 0.5 | 110 | 110 | 118 | 88.0 | 8.0 | 14.0 | 13.0 |

EXAMPLE 3

This example illustrates a multi-stage sequence of the instant invention in a sequential treatment $D_cH_sD$. The multi-stage bleach steps may be defined as an initial sequential chlorine dioxide-chlorine bleach stage followed by a second hypochlorite buffered with a silicate stage and a final chlorine dioxide bleach stage. A portion of the pulp used in Example 1 was employed. The effluent from this bleach sequence contained a total of 613 parts per million chlorides, 1430 parts per million solids and 768 COD parts per million.

TABLE 3

BLEACH RESPONSE AND EFFLUENT COLOR OF SOFTWOOD PULP TO A $D_cH_sD$* SEQUENCE WITH SODIUM SILICATE BUFFER IN THE HYPOCHLORINATION STAGE

| Stage | Temp. ° F. | Time, Min. | Const. % |
|---|---|---|---|
| D | 120 | 5 | 3 |
| | 120 | 25 | |
| $H_s$ | 115 | 60 | 10 |
| D | 160 | 180 | 3 |
| Bleach Stage | $D/_c$ | $H/_{s/NaOH}$ | D |
| Chem. Addition Wt. % | 1.24/3.25 | 2.0/0.5/0.68 | 0.5 |
| Color, ppm | | | |
| Colorimeter Reading | 950 | 600 | 100 |
| Consistency Corrected | 950 | 168 | 100 |
| Volume Corrected | 417 | 73 | 44 |
| Brightness, % | | | |
| Final | 91.2 | | |
| Reversion | | | |
| Δ - 1 hour | 5.1 | | |
| Δ - 18 hours | 10.7 | | |
| Viscosity, centipoise | 17.9 | | |

*Dc Ratio 50/50

The data presented in the proceeding three examples may be summarized for ease of comparison as follows:

SOFTWOOD - PINE SEQUENCE

| Effluent | $D_cH_sD$ | $CH_sD$ | CEHD |
|---|---|---|---|
| Total | | | |
| Color, ppm | 534 | 601 | 3347 |
| Chlorides, ppm | 613 | — | 719 |
| COD, ppm | 768 | — | 813 |
| Solids, ppm | 1430 | — | 1854 |
| Bleached Pulp | | | |
| Brightness, % | | | |

-continued

SOFTWOOD - PINE SEQUENCE

| | | | |
|---|---|---|---|
| Final | 91.2 | 88.0 | 90.5 |
| Reversion | | | |
| Δ - 1 hour | 5.1 | 8.0 | 4.2 |
| Δ - 18 hours | 10.7 | 14.0 | 8.5 |
| Viscosity, cp | 17.9 | 13.0 | 9.9 |
| Chemical Application, % | | | |
| $Cl_2$ | 3.25 | 6.5 | 6.5 |
| NaOH | 0.98 | 1.2 | 2.8 |
| NaOCl | 2.0 | 3.0 | 1.15 |
| $ClO_2$ | 1.74 | 0.5 | 0.45 |
| $Na_2SiO_3$ | 0.5 | 0.5 | — |

It may be seen from these examples that the total colored bodies of effluent from the various bleach sequences described are substantially reduced by the omission of the caustic extraction stage and substitution of a hypochlorite bleach stage under conditions of controlled acidity. In fact, a reduction in colored content of the effluent waters is as great as from about 70 to 90% of that obtained from a bleach sequence including a caustic extraction stage. Furthermore, other apparent advantages residing in the use of a hypochlorite bleach stage under conditions of controlled acidity in lieu of a second stage caustic extraction reside in an effluent containing less chloride ions than that obtained by the control CEHD sequence. Furthermore, 17% less fresh water is required in the multi-stage bleach process of the instant invention due to the elimination of the extraction stage of a CEHD process and its associated wash cycle. Therefore, 17% less effluent results from the improved process of the instant invention. An additional advantage resides in the fact that 30% less steam is required in a three step bleach sequence employing a buffered hypochlorite second bleach stage versus the four stage process CEHD due to the reduction in the number of stages as well as to the lower temperature requirements for a buffered hypochlorite bleach stage when compared to the temperature necessary for alkaline extraction. Obviously, the reduction of the number of stages needed to achieve the desired bleaching response from four stages of CEHD to three stages of the instant invention is a decided advantage, likewise a better pulp quality results from the process of the instant invention as may be noted from the viscosity data presented in the preceding summary table.

Applicants discovery that a hypochlorite bleach stage under conditions of controlled acidity may be substituted for an alkaline extraction stage is all the more surprising in view of the fact that conventional hypochlorite bleach techniques are conducted at very high pH's generally from 10 to 12 which in much of the literature is described as a very desirable if not critical reaction parameter for hypochlorite treatments of cellulosic pulps.

EXAMPLE 4

The effect of sodium hydroxide concentration for pH control in the hypochlorite bleach stage of a sequence $D_cH_sD$ at a constant silicate level was determined. This information demonstrates that the amount of colored material produced during hypochlorination can be decreased by controlling the pH. The viscosity also increases slightly as the pH is raised. The change on 18 hour reversion in brightness shows a derease as the pH is increased. The final brightnesses are essentially equivalent.

TABLE 4

EFFECT OF NaOH CONCENTRATION IN HYPOCHLORINATION STAGE OF A $D_cH_sD$ SEQUENCE ON SOFTWOOD PULP AT CONSTANT SILICATE LEVEL

| Stage | Concentration, % | $D_c$ Ratio | Temperature ° F. | Time, Minutes | Consistency, % |
|---|---|---|---|---|---|
| D | 1.24 $ClO_2$ | 50/50 | 120 | 5 | 3 |
| | 3.25 $Cl_2$ | | 120 | 25 | |
| $H^c$ | 2.0 NaOCl | | 115 | 60 | 10 |
| | 0.5 $Na_2SiO_3$ | | | | |
| $D^s$ | 0.5 $ClO_2$ | | 160 | 180 | 3 |
| | | Total Color | Brightness. % | | Viscosity |
| NaOH % | Final pH | ppm | Final | Δ - 18 hrs. rev. | centipoise |
| 0.5 | 7.0 | 587 | 88.3 | 12.4 | 17.8 |
| 1.0 | 9.1 | 673 | 89.8 | 9.6 | 19.7 |
| 20 | 11.0 | 744 | 90.8 | 7.8 | 20.0 |

EXAMPLE 5

The effect of silicate concentration on pH control in the hypochlorite bleach stage of a $D_cH_sD$ sequence with soft wood pulp at a constant sodium hydroxide level was determined for both the stepwise addition of sodium hydroxide, silicate and hypochlorite as well as for a premixed addition of these reagents in the hypochlorite bleach stage. As the rinal pH is increased, the effluent color increases. The viscosity also increases slightly. This data demonstrates that there is little or no difference in the mode of addition of the reagents in the hypochlorite stage. The data presented in the following table when compared with that of Table IV demonstrates that the buffering of the hypochlorite stage with sodium silicate in a bleach sequence $D_cH_sD$ yields a total effluent color that is about 100–200 parts per million less than is obtained with the sodium hydroxide pH adjustments.

TABLE 5

EFFECT OF SILICATE CONCENTRATION IN HYPOCHLORINATION STAGE OF A $D_cH_sD$ SEQUENCE AT CONSTANT NaOH LEVEL

| Stage | Concentration, % | $D_c$ Ratio | Temperature ° F. | Time, Minutes | Consistency, % |
|---|---|---|---|---|---|
| D | 1.24 $ClO_2$ | 50/50 | 120 | 5 | 3 |
| | 3.25 $Cl_2$ | | 120 | 25 | |
| $H_s^c$ | 2.0 NaOCl | | 115 | 60 | 10 |
| | 0.68 NaOH | | | | |
| D | 0.5 $ClO_2$ | | 160 | 180 | 3 |
| | | | Total Color | Brightness, % | Viscosity |
| | $Na_2SiO_3$% | Final pH | ppm | Final / Δ - 18 hrs. rev. | centipoise |
| Stepwise Addition in $H_s$ Stage | | | | | |
| | 0.0 | 7.2 | 497 | 90.6 / 11.3 | 9.8 |
| | 0.5 | 7.8 | 515 | 90.6 / 11.4 | 12.2 |
| | 1.0 | 8.2 | 525 | 90.5 / 10.7 | 13.9 |
| | 2.0 | 7.8 | 550 | 90.0 / 10.5 | 14.4 |
| | 3.0 | 8.5 | 536 | 90.3 / 10.7 | 15.0 |
| | 4.0 | 8.7 | 578 | 89.9 / 10.4 | 16.0 |
| Pre Mixed Addition in $H_s$ Stage | | | | | |
| | 0.0 | 7.5 | 541 | 89.5 / 12.0 | 12.4 |
| | 0.5 | 7.7 | 537 | 89.6 / 12.1 | 13.8 |
| | 1.0 | 8.1 | 551 | 90.3 / 12.0 | 13.2 |
| | 2.0 | 8.3 | 544 | 90.6 / 11.0 | 15.0 |
| | 3.0 | 8.6 | 544 | 90.6 / 11.1 | 15.9 |
| | 4.0 | 8.6 | 577 | 90.2 / 11.2 | 16.4 |

Analysis of the information presented in Examples I–V demonstrates that the greatest reduction in effluent color is obtained from the $D_cH_sD$ sequence wherein a $D_c$ ratio of 50:50 is employed at a temperature of 120° F. over a 30 minute period followed by a hypochlorite bleach stage which is buffered with 0.5%-1.0% sodium silicate (35° Be) to a pH of 7.8-8.2. The brightness is equivalent or greater than the CEHD control (91.2 versus 90.5). The viscosity (17.9 versus 9.9) is much better than the control. The change in 1 hour brightness reversions (5.1 versus 4.2) are slightly higher for the bleach sequence $D_cH_sD$.

EXAMPLE 6

This example essentially duplicates the experiment presented in Example I, with the exception that the bleaching sequence CEHD was applied to hardwood pulp as opposed to soft wood pulp. The data presented in Table 6 represents a control for the system CEHD applied to hard wood pulp.

TABLE 6

BLEACH RESPONSE AND EFFLUENT COLOR OF HARD WOOD PULP TO THE CONTROL CEHO SEQUENCE

| Stage | Temp. ° F. | Time, Min. | Const. % | |
|---|---|---|---|---|
| C | 100 | 60 | 3 | |
| E | 100 | 60 | 10 | |
| H | 115 | 60 | 10 | |
| D | 160 | 180 | 3 | |
| Bleach Stage | C | E | H/NaOH | D |
| Chem. Addition Wt. % | 4.0 | 2.0 | 1.4/0.5 | 0.5 |
| Color, ppm | | | | |
| Colorimeter Reading | 580 | 7,400 | 250 | 200 |
| Consistency Corrected | 580 | 2,072 | 70 | 200 |
| Volume Corrected | 227 | 809 | 27 | 78 |
| Brightness, % | | | | |
| Final | 86.1 | | | |
| Reversion | | | | |
| Δ - 1 hour | 3.1 | | | |
| Δ - 18 hours | 5.4 | | | |
| Viscosity, centipoise | 14.7 | | | |

EXAMPLE 7

A portion of the same hard wood pulp bleached in accordance with the sequence CEHD as presented in Example 6 was bleached by the sequence $D_cH_sD$ of this invention. The conditions and results are presented in Table 7.

TABLE 7

BLEACH RESPONSE AND EFFLUENT COLOR OF HARD WOOD PULP TO THE $D_cH_sD$ SEQUENCE

| Stage | Temp. ° F. | Time, Min. | Const. % |
|---|---|---|---|
| D | 120 | 5 | 3 |
| $H_s^c$ | 120 | 25 | |
| D | 115 | 60 | 10 |
| Bleach Stage | 160 | 180 | 3 |
| Chem. Addition wt. % | D/c 0.76/2.0 | H/s/NaOH 2.0/0.5/0.68 | D 0.5 |
| Color, ppm | | | |
| Colorimeter Reading | 600 | 1000 | 100 |
| Consistency Corrected | 600 | 280 | 100 |
| Volume Corrected | 263 | 123 | 44 |
| Brightness, % | | | |
| Final | 85.8 | | |
| Reversion | | | |
| Δ - 1 hour | 3.4 | | |
| Δ - 18 hours | 6.4 | | |
| Viscosity, centipoise | 15.5 | | |

The comparative results obtained in Examples 6 and 7 may be best analyzed through references to the following summary table, in which it may be seen that the decrease in color of the waste effluent from the $D_cH_sD$ sequence of this invention is marked and attended by a decrease in the chlorides content, solids content and the COD requirement. At the same time, with a very small loss of brightness in the final product, the viscosity is higher.

HARDWOOD

| EFFLUENT | SEQUENCE | |
|---|---|---|
| Total | $D_cH_sD$ | CEHD |
| Color, ppm | 430 | 1141 |
| Chlorides, ppm | 484 | 558 |
| COD, ppm | 363 | 507 |
| Solids, ppm | 1096 | 1290 |
| Bleach Pulp | | |

HARDWOOD-continued

| | | |
|---|---|---|
| Brightness, % | | |
| Final | 85.8 | 86.1 |
| Reversion | | |
| Δ - 1 hour | 3.4 | 3.1 |
| Δ - 18 hours | 6.4 | 5.4 |
| Viscosity, centipoise | 15.5 | 14.7 |
| Chemical Application, % | | |
| $Cl_2$ | 2.0 | 4.0 |
| NaOH | 0.98 | 2.8 |
| NaOCl | 2.0 | 1.4 |
| $ClO_2$ | 1.26 | 0.5 |
| $Na_2SiO_3$ | 0.5 | — |

The percent reduction of contaminants in the effluent from the bleach sequence $D_cH_sD$ when compared to the known sequence CEHD for both hard wood and soft wood pulp is as follows:

PERCENT REDUCTION OF EFFLUENT CONTAMINANTS $D_cH_sD$ SEQUENCE $D_cH_sD$ vs CEHD Sequence % REDUCTION

| | SOFTWOOD | | HARDWOOD | |
|---|---|---|---|---|
| Contaminant | Total | At equivalent* volume | total | At equivalent* volume |
| Color | 84 | 86 | 62 | 66 |
| Chlorides | 15 | 24 | 13 | 23 |
| COD | 6 | 16 | 28 | 36 |
| Solids | 23 | 31 | 15 | 24 |

*The $D_cH_sD$ effluent represents a 17% reduction when compared to that of the CEHD sequence. These % reduction figures have been calculated on the basis of equivalent volume.

EXAMPLE 8

A slurry of kraft softwood pulp was prepared and divided into 25 gram oven dried samples. These samples were then subjected to chlorination at 3.0% consistency for 30 minutes at 75° F with 6.5% available chlorine. The so treated samples were then subjected to hypochlorination at 10.0% consistency for 60 or 90 minutes at 115° F with 2.0% available chlorine. The hypochlorinating solution was buffered with 0.5% sodium silicate. Sodium hydroxide was added during hypochlorination in amounts up to 1.4% so as to vary the pH of hypochlorination. Upon completion of the hypochlorination period, the aqueous effluent from each treated sample was separated from the pulp using a Buchner funnel. The effluent was then tested for color content, using the Hach colorimeter, to determine color in parts per million. The results are tabulated in Table 8.

TABLE 8

| Sample | Hrs. Hypo. | pH | Color ppm |
|---|---|---|---|
| 1 | 1.0 | 5.6 | 4,400 |
| 2 | 1.5 | 5.6 | 4,000 |
| 3 | 1.0 | 7.0 | 3,900 |
| 4 | 1.5 | 7.2 | 3,900 |
| 5 | 1.0 | 7.3 | 6,000 |
| 6 | 1.5 | 7.4 | 7,300 |
| 7 | 1.5 | 8.7 | 7,400 |
| 8 | 1.5 | 9.1 | 8,400 |
| 9 | 1.0 | 9.9 | 8,200 |
| 10 | 1.0 | 9.3 | 8,200 |
| 11 | 1.0 | 10.0 | 8,200 |

EXAMPLE 9

25 gram oven dried samples of the Kraft softwood pulp of Example 1 were subjected to sequential treatment with chlorine dioxide for 5 minutes at 75° F at 3.25% equivalent chlorine dioxide and then to chlorination at 3.25% equivalent chlorine for 25 minutes at 75° F at a consistency of 3.0%. Each sample was thereafter water washed and subjected to hypochlorination as in Example 1. The results are tabulated in Table 9.

TABLE 9

| Sample | Hrs. Hypo. | pH | Color ppm |
|---|---|---|---|
| 1 | 1.0 | 5.9 | 700 |
| 2 | 1.0 | 6.7 | 1510 |
| 3 | 1.0 | 7.1 | 1600 |
| 4 | 1.0 | 8.2 | 1500 |
| 5 | 1.0 | 9.2 | 2000 |
| 6 | 1.0 | 10.2 | 2000 |
| 7 | 1.0 | 10.9 | 2000 |

As can be seen from the results tabulated in Tables 8 and 9, color body content of the effluent stream is substantially reduced when hypochlorination is accomplished at a pH range between about 6 and 9.

EXAMPLE 10

Samples of Western Pine Kraft pulp, having a permanganate number 20.7 and a viscosity of 27.6 centipoises, were independently subjected to the sequence of the instant invention, DcHsDED, or a commercial CEDED bleach sequence in accordance with the conditions tabulated below

| Stage | % Chemical Addition | Time (Min) | Temp. ° F. | Pulp Compt. |
|---|---|---|---|---|
| (C)hlorination | 6.0 | 60 | 80 | 3* |
| (E)xtraction | 2.0 | 60 | 160 | 10 |
| (D)Chlorine Dioxide | 1.5 | 180 | 160 | 3 |
| (E)xtraction | 0.5 | 90 | 160 | 10 |
| (D)Chlorine Dioxide | 0.4 | 180 | 160 | 3 |
| (Dc)Sequential Chlorination | 1.1 $ClO_2$ 3.0 $Cl_2$ | 30 | 80 | 3* |
| (Hs)ypochlorination | 2.5 | 60 | 115 | 10 |
| (D)Chlorine Dioxide | 1.1 | 180 | 160 | 3 |
| (E)xtraction | 0.5 | 60 | 160 | 10 |
| (D)Chlorine Dioxide | 0.4 | 180 | 160 | 3 |

*3% consistency has been chosen for ease of laboratory operation. Results obtained are equivalent to those when using a consistency of 10–12%.

The brightness and one hour reversion time was measured as in Example 1 of the pulp undergoing the CEDED sequence and a final Elrepho brightness of 88.5% was found together with an Elrepho brightness reversion of 2.3%. In a like manner measurements of the pulp undergoing the DcHsDED sequence was found to have a final Elrepho brightness of 89.3% together with an Elrepho brightness reversion of 1.7%.

Biological Oxygen Demand (BOD) of the effluent from each stage of the afore-described sequences was measured at 3% consistency by the process of Standard Methods of Examination of Water and Waste Water, ALPHA, 13th Edition, 1971. The results are as indicated in Table 10.

TABLE 10

| | CEDED | | DeHsDED | |
|---|---|---|---|---|
| Stage No. | Stage | BOD mg/l | BOD mg/l | Stage |
| | C | 187 | 154 | Dc |
| 2 | E | 113 | 68 | Hs |
| 3 | D | 45 | 40 | D |
| 4 | E | 30 | 37 | E |
| 5 | D | 10 | 12 | D |
| Composite | | 76 | 63 | Composite |

It is pointed out that the BOD, i.e., the quantity of dissolved oxygen (mg/1) required during stabilization of the decomposable organic matter by aerobic biochemical action in an effluent, of the DcHsDED sequence is substantially lower than that of the control CEDED sequence, especially in Stage Number 2.

EXAMPLE 11

The effluents from each stage of the bleaching sequences in Example 10 were subjected to Fish Bioassay toxicity tests to determine their comparative effect upon fish ecology when discharged into their habitat. Rainbow trout, of from about 2 to 2½ inches in length were subjected to varying concentrations of effluent in water for a four day period of time to determine its effect. Composite tests were also run by mixing equal volumes of effluent from each stage of the bleaching sequence, the results are tabulated in Table II.

It is pointed out that in each stage and in the composite, fish can accept more effluent from the DcHsDED sequence then the CEDED control sequence with less effect upon their survival. It should be especially noted that a comparison of the composite discharge, which most closely represents commercial operation, shows the DcHsDED sequence to be significatly less toxic than the CEDED sequence.

Thus, it is apparent to one skilled in this art that as a pollution control device, the substitution of the buffered hypochlorination bleach stage of this invention for the conventional caustic extraction of both soft and hard wood pulp has wide applicability and may be applied in a three or more step bleach sequence to both soft and hard wood pulps prepared by the kraft or sulfite technique.

TABLE 11

| | Fish Bioassay CEDED Control Vs DcHsDED Toxicity - % Effluent Concentration | | | | | |
|---|---|---|---|---|---|---|
| | 100% Survival | | 96 Hr 50% Mortality | | 100% Mortality | |
| Stage | CEDED Control | DcHsDED | CEDED Control | DchsDED | CEDED Control | DcHsDED |
| 1 | 5 | 20 | 16 | 28 | 25 | 40 |
| 2 | 15 | 40 | 35 | 50 | >65 | |
| 3 | >65 | >65 | — | — | — | — |
| 4 | >65 | >65 | — | — | — | — |
| 5 | >65 | >65 | — | — | — | — |
| Composite | 25 | >65 | 50 | — | >65 | — |

What is claimed is:

1. In a process for bleaching cellulosic pulp wherein cellulosic pulp is bleached in aqueous suspension with at least one member of the group consisting of chlorine and chlorine dioxide to a solubilize non-cellulosic material associated with said cellulosic pulp and wherein said pulp is thereafter subjected to extraction, the improvement comprising reducing effluent color from 50 to 90 percent by subjecting said pulp at a weight consistency of 3 to 15 percent, to said extraction by hypochlorination with about 0.5 to about 3.0 percent hypochlorite on a dry pulp weight basis, at a temperature from about 75 to about 160 degrees F., for 15–180 minutes and controlling the hypochlorination pH from about 6 to less than 9.

2. The process of claim 1 in which the pH during the hypochlorination stage is from about 6 to about 8.5.

3. The process of claim 1 in which the pH during the hypochlorination stage is from about 6 to about 8.2.

4. The process of claim 1 in which the pH of said cellulosic pulp is adjusted prior to treatment with said hypochlorite by the addition of an alkali metal hydroxide.

5. The process of claim 1 in which the pH of said cellulosic pulp is controlled during hypochlorination by the addition of from about 0.5 to 1 percent of a water soluble silicate based upon the dry weight of said pulp.

6. The process of claim 5 in which said water soluble silicate is of the formula $Na_2O(SiO_2)_x$ in which $x$ is from 2 to 4.

7. The process of claim 5 in which said water soluble silicate is of the formula $Na_2SiO_3$.

8. The process of claim 1 in which the treatment of said cellulosic pulp with hypochlorite is conducted for a period of from 30 to 90 minutes.

9. In a multi-stage bleach process for cellulosic pulp, the improvement comprising reducing effluent color from 50 to 90 percent by the application of the following stages, seriatim, to an aqueous pulp suspension at a consistency of 3 to 15 percent by weight;

a. bleaching said cellulosic pulp with chlorine dioxide and thereafter bleaching said cellulosic pulp with chlorine, wherein about 2 to about 90 percent of the total available chlorine in said chlorine dioxide and chlorine is added as chlorine dioxide, b. extracting said cellulosic pulp with about 0.5 to about 3.0 percent alkali metal hypochlorite on a dry pulp weight basis at a controlled pH from about 6 to less than 9, and then c. bleaching said cellulosic pulp with chlorine dioxide.

10. In a multi-stage bleach process for cellulosic pulp, the improvement comprising reducing effluent color from 50 to 90 percent by the application of the following stages to a cellulosic pulp at a consistency of 3 to 15 percent by weight, seriatim:

a. bleaching said cellulosic pulp in a first stage with chlorine, b. extracting said cellulosic pulp in a second stage with about 0.5 to about 3.0 percent alkali metal hypochlorite on a dry pulp weight basis at a controlled pH from about 6 to less than 9, and then c. bleaching said cellulosic pulp in a third stage with chlorine dioxide.

11. A process for reducing the colored body content of effluents from 50 to 90 percent from a multi-stage, cellulosic pulp, bleaching process, utilizing a first stage bleach for solubilizing non-cellulosic material associated with said cellulosic pulp, which comprises subjecting the first stage bleached pulp to hypochlorite extraction at a pulp consistency of 3 to 15 percent by weight with about 0.5 to 3.0 percent hypochlorite based upon the dry weight of said pulp at a controlled pH of from about 6 to less than 9, maintained by the addition of water soluble silicate buffer, at a temperature from about 100° to about 160° F. for a period of time from about 30 to about 50 minutes.

12. A multi-stage bleach process for cellulosic pulp comprising reducing effluent color from 50 to 90 percent by the application of the following stages, seriatim, to an aqueous pulp suspension at a consistency of 3 to 15 percent by weight:

a. bleaching said cellulosic pulp with chlorine dioxide and thereafter bleaching said cellulosic pulp with chlorine, wherein about 2 to about 90 percent of the total available chlorine in said chlorine dioxide and chlorine is added as chlorine dioxide, b. extracting said cellulosic pulp with about 0.5 to about 3.0 percent alkali metal hypochlorite on a dry pulp weight basis at a controlled pH from about 6 to less than 9, c. bleaching said cellulosic pulp with chlorine dioxide, d. extracting said cellulosic pulp with sodium hydroxide, and then e. bleaching said cellulosic pulp with chlorine dioxide.

13. A multi-stage bleach process for cellulosic pulp comprising reducing effluent color from 50 to 90 percent by the application of the following stages, seriatim, to an aqueous pulp suspension at a consistency of 3 to 15 percent weight:

a. bleaching said cellulosic pulp with a mixture of chlorine and chlorine dioxide, wherein about 2 to about 90 percent of the total available chlorine in said chlorine dioxide and chlorine is added as chlorine dioxide, b. extracting said cellulosic pulp with about 0.5 to about 3.0 percent alkali metal hypochlorite on a dry pulp weight basis at a controlled pH from about 6 to less than 9, and then c. bleaching said cellulosic pulp with chlorine dioxide.

14. A multi-stage bleach process for cellulosic pulp comprising reducing effluent color from 50 to 90 percent by the application of the following stages, seriatim, to an aqueous pulp suspension at a consistency of 3 to 15 percent by weight:

a. bleaching said cellulosic pulp with a mixture of chlorine and chlorine dioxide, wherein from about 2 to about 90 percent of the total available chlorine in said chlorine dioxide and chlorine is added as chlorine dioxide, b. extracting said cellulosic pulp with about 0.5 to about 3.0 percent alkali metal hypochlorite on a dry pulp weight basis at a controlled pH from about 6 to less than 9, c. bleaching said cellulosic pulp with chlorine dioxide, d. extracting said cellulosic pulp with sodium hydroxide, and then e. bleaching said cellulosic pulp with chlorine dioxide.

15. A multi-stage bleach process for cellulosic pulp comprising reducing effluent color from 50 to 90 percent by the application of the following stages, seriatim, to an aqueous pulp suspension at a consistency of 3 to 15 percent by weight.

a. bleaching said cellulosic pulp with chlorine, and b. thereafter extracting said cellulosic pulp with about 0.5 to about 3.0 percent alkali metal hypochlorite on a dry pulp weight basis at a controlled pH from about 6 to less than 9.

* * * * *